US007073758B2

(12) United States Patent
Whittemore et al.

(10) Patent No.: US 7,073,758 B2
(45) Date of Patent: Jul. 11, 2006

(54) POLE CLAMP FOR PARTITION MOUNT

(75) Inventors: Jeffrey P. Whittemore, Arlington, MA (US); Michael D. Cattafe, Bolton, MA (US)

(73) Assignee: Zipwall, LLC, Arlington, MA (US)

( * ) Notice: Subject to any disclaimer, the term of this patent is extended or adjusted under 35 U.S.C. 154(b) by 0 days.

(21) Appl. No.: 10/600,939

(22) Filed: Jun. 20, 2003

(65) Prior Publication Data

US 2004/0031892 A1 Feb. 19, 2004

Related U.S. Application Data

(60) Provisional application No. 60/403,683, filed on Aug. 15, 2002.

(51) Int. Cl.
*A47B 96/06* (2006.01)

(52) U.S. Cl. ..... 248/218.4; 248/229.13; 248/230.4; 405/150.1; 454/170; 24/338

(58) Field of Classification Search ..... 248/230.4, 248/231.51, 229.13, 218.4, 74.1, 62; 454/170; 405/150.1; 160/368.1, 349.1, 349.2; 24/338, 24/339, 334, 349, 499, 500
See application file for complete search history.

(56) References Cited

U.S. PATENT DOCUMENTS

| | | | | |
|---|---|---|---|---|
| 827,000 | A | 7/1906 | Dinsmore | |
| 1,766,324 | A * | 6/1930 | Berner | 454/170 |
| 2,219,169 | A | 10/1940 | Alter | 248/1 |
| 2,232,194 | A | 2/1941 | Zogby | 156/33 |
| 2,474,158 | A | 6/1949 | Neely | 155/180 |
| 2,487,585 | A * | 11/1949 | Pencek | 248/51 |
| 2,816,769 | A | 12/1957 | Noble | 279/83 |
| 2,903,227 | A | 9/1959 | de Kalb Key | 248/356 |
| 2,942,829 | A | 6/1960 | Stiffel | 248/193 |
| 3,072,784 | A | 1/1963 | Mann | 240/81 |
| 3,090,826 | A * | 5/1963 | Cochran | 174/158 R |
| 3,118,363 | A | 1/1964 | Burgess, Jr. | 98/50 |
| 3,247,558 | A | 4/1966 | Kaufman | 24/81 |
| 3,322,381 | A * | 5/1967 | Bubb | 248/121 |
| 3,327,310 | A | 6/1967 | Bethune et al. | 343/702 |
| 3,333,808 | A | 8/1967 | Du Boff | 248/354 |
| 3,350,120 | A | 10/1967 | Hinrichs | 287/58 |
| 3,529,860 | A | 9/1970 | Jelley | 287/189.36 |
| 3,592,434 | A | 7/1971 | Murray | 248/480 |
| 3,604,397 | A | 9/1971 | Salerno | 119/29 |
| 3,608,991 | A | 9/1971 | Wade | 312/345 |
| 3,713,643 | A | 1/1973 | Gerstenberger | 270/61 |
| 3,767,253 | A | 10/1973 | Kluetsch | 296/24 R |
| 3,792,510 | A | 2/1974 | Evett | 24/243 |
| 3,822,850 | A | 7/1974 | Elias | 248/354 S |

(Continued)

FOREIGN PATENT DOCUMENTS

DE 3918516 A1 6/1989

(Continued)

*Primary Examiner*—Korie Chan
(74) *Attorney, Agent, or Firm*—Mills & Onello LLP

(57) ABSTRACT

A partition mounting system a system mitigates or eliminates sag, or gaps, between an installed curtain and an abutting surface such as a wall or ceiling. The system accomplishes this in a manner that avoids permanent damage to the wall or ceiling surface. A clamp is mounted between an erected pole and a nearby wall, window, or other surface. The clamp interfaces with a head that urges the curtain against the wall over the length of the head, using the pole and wall for leverage. In this manner, the effectiveness of an installation is increased, by reducing or eliminating gaps in the curtain along the wall.

79 Claims, 14 Drawing Sheets

U.S. PATENT DOCUMENTS

| | | | | | |
|---|---|---|---|---|---|
| 3,952,877 | A | | 4/1976 | Kindl | 211/105.5 |
| 3,956,784 | A | | 5/1976 | Vargas | 5/362 |
| 3,972,272 | A | * | 8/1976 | Bagby | 454/169 |
| 4,078,756 | A | | 3/1978 | Cross | 248/226.4 |
| 4,087,006 | A | | 5/1978 | Schill | 211/86 |
| 4,111,217 | A | | 9/1978 | Victor | 135/15 |
| 4,139,101 | A | | 2/1979 | Towfigh | 211/86 |
| 4,277,863 | A | * | 7/1981 | Faneuf | 24/3.12 |
| 4,379,654 | A | * | 4/1983 | Rovelli | 405/53 |
| 4,396,325 | A | | 8/1983 | Joice-Cavanagh | 410/129 |
| 4,488,651 | A | | 12/1984 | Bishop | 211/105.6 |
| 4,502,256 | A | | 3/1985 | Hahn | 52/63 |
| 4,536,924 | A | | 8/1985 | Willoughby | 24/487 |
| 4,576,354 | A | | 3/1986 | Blessing, Sr. | 248/354.5 |
| 4,592,797 | A | | 6/1986 | Carlson | 156/574 |
| 4,645,473 | A | | 2/1987 | Mochizuki | 464/79 |
| 4,662,034 | A | | 5/1987 | Cunningham | 24/90 |
| 4,708,189 | A | | 11/1987 | Ward | 160/351 |
| 4,715,089 | A | | 12/1987 | Schema | 16/115 |
| 4,717,107 | A | | 1/1988 | Servadio | 248/353 |
| 4,770,086 | A | | 9/1988 | Gabster | 98/50 |
| 4,794,974 | A | | 1/1989 | Melino | 160/330 |
| 4,824,302 | A | | 4/1989 | Schultheis et al. | 410/151 |
| 4,874,028 | A | | 10/1989 | Lynch et al. | 160/332 |
| 4,885,876 | A | | 12/1989 | Henke | 51/393 |
| 4,907,835 | A | | 3/1990 | Salters | 296/1.1 |
| 4,912,814 | A | | 4/1990 | McKenzie | 24/115 |
| 4,969,241 | A | | 11/1990 | Griffin | 24/113 |
| 5,038,889 | A | | 8/1991 | Jankowski | 182/129 |
| 5,040,915 | A | | 8/1991 | Stuart et al. | 403/322 |
| 5,056,753 | A | | 10/1991 | Lunau et al. | 248/542 |
| 5,078,348 | A | | 1/1992 | Babitchenko | 248/124 |
| 5,116,012 | A | | 5/1992 | Offenhauer et al. | 248/452 |
| 5,129,774 | A | | 7/1992 | Balseiro et al. | 414/11 |
| 5,170,974 | A | | 12/1992 | Ruggiero | 248/251 |
| 5,287,614 | A | | 2/1994 | Ehrlich | 29/450 |
| 5,301,915 | A | | 4/1994 | Bahniuk et al. | 248/452 |
| 5,308,280 | A | | 5/1994 | Dotson | 454/170 |
| 5,345,989 | A | | 9/1994 | Brophy | 160/354 |
| 5,375,303 | A | | 12/1994 | Shenier | 24/163 |
| 5,379,491 | A | | 1/1995 | Solo | 24/3 |
| 5,384,938 | A | | 1/1995 | Frederick | 24/306 |
| 5,388,283 | A | | 2/1995 | Garnett | 4/503 |
| 5,404,602 | A | | 4/1995 | Kondo | 5/504.1 |
| 5,469,607 | A | * | 11/1995 | Henningsson et al. | 24/716 |
| 5,497,537 | A | | 3/1996 | Robinson et al. | 24/716 |
| 5,524,693 | A | | 6/1996 | Hamilton | 160/243 |
| 5,529,326 | A | | 6/1996 | Hwang | 280/220 |
| 5,536,229 | A | | 7/1996 | Albergo | 482/148 |
| 5,542,209 | A | * | 8/1996 | Sheu | 47/44 |
| 5,555,607 | A | * | 9/1996 | Parveris | 24/129 R |
| 5,558,501 | A | | 9/1996 | Wang et al. | 416/244 |
| 5,584,456 | A | * | 12/1996 | Stephens | 248/214 |
| 5,649,780 | A | | 7/1997 | Schall | 403/109 |
| 5,666,702 | A | * | 9/1997 | Ming-Chieh | 24/510 |
| 5,673,741 | A | | 10/1997 | Cairns | 160/330 |
| 5,707,032 | A | | 1/1998 | Ehrlich | 248/205.3 |
| 5,715,620 | A | * | 2/1998 | Walker | 40/591 |
| 5,803,653 | A | | 9/1998 | Zuffetti | 403/363 |
| 5,832,652 | A | * | 11/1998 | Bartys | 43/17 |
| 5,884,424 | A | | 3/1999 | Smith | 40/610 |
| 5,897,085 | A | | 4/1999 | Cronin | 248/200.1 |
| 5,918,843 | A | * | 7/1999 | Stammers | 248/230.6 |
| 5,924,469 | A | | 7/1999 | Whittemore | 160/368.1 |
| 5,937,488 | A | * | 8/1999 | Geiger | 24/339 |
| 5,940,942 | A | | 8/1999 | Fong | 24/459 |
| 5,941,434 | A | | 8/1999 | Green | 224/250 |
| 5,941,586 | A | | 8/1999 | Fann | 294/19.1 |
| 5,979,110 | A | * | 11/1999 | Tai | 47/41.01 |
| 6,152,434 | A | | 11/2000 | Gluck | 269/6 |
| 6,164,605 | A | * | 12/2000 | Drake et al. | 248/74.3 |
| 6,209,615 | B1 | | 4/2001 | Whittemore | 160/368.1 |
| 6,378,175 | B1 | * | 4/2002 | Vanderpan | 24/336 |
| 6,467,741 | B1 | | 10/2002 | Shih | 248/200.1 |
| 6,508,295 | B1 | | 1/2003 | Whittemore | 160/368.1 |
| 6,523,231 | B1 | * | 2/2003 | Lassiter | 24/339 |
| 2003/0154588 | A1 | | 8/2003 | Blacket et al. | 29/456 |

FOREIGN PATENT DOCUMENTS

| | | |
|---|---|---|
| DE | 29605222 | 7/1996 |
| FR | 2411282 | 6/1979 |
| GB | 1042086 | 9/1966 |
| WO | WO86/03538 | 6/1986 |
| WO | WO91/09556 | 7/1991 |

* cited by examiner

POLE CLAMP FOR PARTITION MOUNT

RELATED APPLICATIONS

This application claims the benefit of the filing date of U.S. Provisional Patent Application Ser. No. 60/403,683, filed Aug. 15, 2002.

BACKGROUND OF THE INVENTION

Partition systems are often employed to isolate portions of a building or room, by serving as a barrier to dust, noise, light, odors, and the like. In construction zones, partitions are useful for protecting a clean area from a work area, for example, protecting an area where furniture and rugs are temporarily stored from an area where wood floors are being refinished.

Workers at construction sites often use rudimentary techniques for installing partitions. Some simply nail, screw, or staple the curtain or partition material to the floor, ceiling, and abutting walls, resulting in damage to their surfaces. Others tape, or otherwise adhere, a curtain or plastic sheet to the walls and ceilings. The tape usually fails to stick, but if it does stick, as the tape is removed, paint can pull off with the tape, or adhesive is left behind.

U.S. Pat. No. 5,924,469, the content of which is incorporated herein by reference, discloses a partition mount system that addresses these limitations. This system offers the advantage of accommodating standard extension poles, for example, painters poles, with standard threads, and is compatible with a variety of commercially-available curtain or drape materials, for example plastic, cloth, and the like. The disclosed system is a "clean" system designed to be installed and removed without damaging or otherwise marking the ceiling, floor or walls in the construction zone. Assembly is easy and fast and can be accomplished by a single individual. In certain applications however, a sag, or gap, may be present in the curtain along a mounting pole next to a wall, ceiling, door frame, or other abutting surface, compromising the effectiveness of the installation.

SUMMARY OF THE INVENTION

The present invention is directed to a system that mitigates or eliminates sag, or gaps, between an installed curtain and an abutting surface such as a wall or ceiling. The system accomplishes this in a manner that avoids permanent damage to the wall or ceiling surface. A clamp is mounted between an erected pole and a nearby wall, window, or other surface. The clamp interfaces with a head that urges the curtain against the wall over the length of the head, using the pole and wall for leverage. In this manner, the effectiveness of the installation is increased, by reducing or eliminating gaps in the curtain along the wall.

In one aspect, the present invention is directed to a partition mount for mounting between a pole and an abutting surface. The mount includes a pole interface coupled to a mount body, the pole interface adapted for interfacing with a side portion of a pole. A head interface is coupled to the mount body. A biasing unit outwardly biases the pole interface and head interface with respect to each other.

The pole interface is for example located at a first end of the mount body and wherein the head interface is at a second end of the mount body. The pole interface comprises, for example, a C-shaped body formed of non-skid material.

The head interface preferably comprises a clamp that is adapted for coupling the partition mount to a head. The head comprises an elongated pad, for example formed of non-skid compressible material, or optionally a small pad that provides a point of contact. In one example, the head interface comprises one of a ball and socket. The head interface may optionally be integral with the mount body.

The mount body, head interface, and pole interface may be configured along a common axis. In another embodiment, the mount body comprises first and second arms coupled by a hinge, and the pole interface is coupled to the first arm and the head interface is coupled to the second arm. The first arm is C-shaped and includes the pole interface at a first end and a first handle at a second end. The first arm further includes a wall interface of non-skid material between the first end and the second end. The second arm is L-shaped and includes the head interface at a first end and a second handle at a second end. The second arm may include a hinge for allowing the head interface and handle to be positioned at a range of angles.

The biasing unit comprises a spring, for example, either inwardly biased and outwardly biased, depending on the configuration. Alternatively, the biasing unit may comprise at least one of a ratcheting mechanism and a manually operated screw.

A wall interface may optionally be coupled to the mount body, for example comprising non-skid material.

The mount body for example comprises a material selected from the group consisting of plastic, graphite, wood, and aluminum alloy.

In another aspect, the present invention is directed to a partition mount for mounting between a pole and an abutting surface. A mount body comprises first and second arms coupled by a hinge. A pole interface is coupled to the first arm, the pole interface adapted for interfacing with a side portion of a pole. A head interface is coupled to the second arm. A biasing unit outwardly biases the pole interface and head interface with respect to each other.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
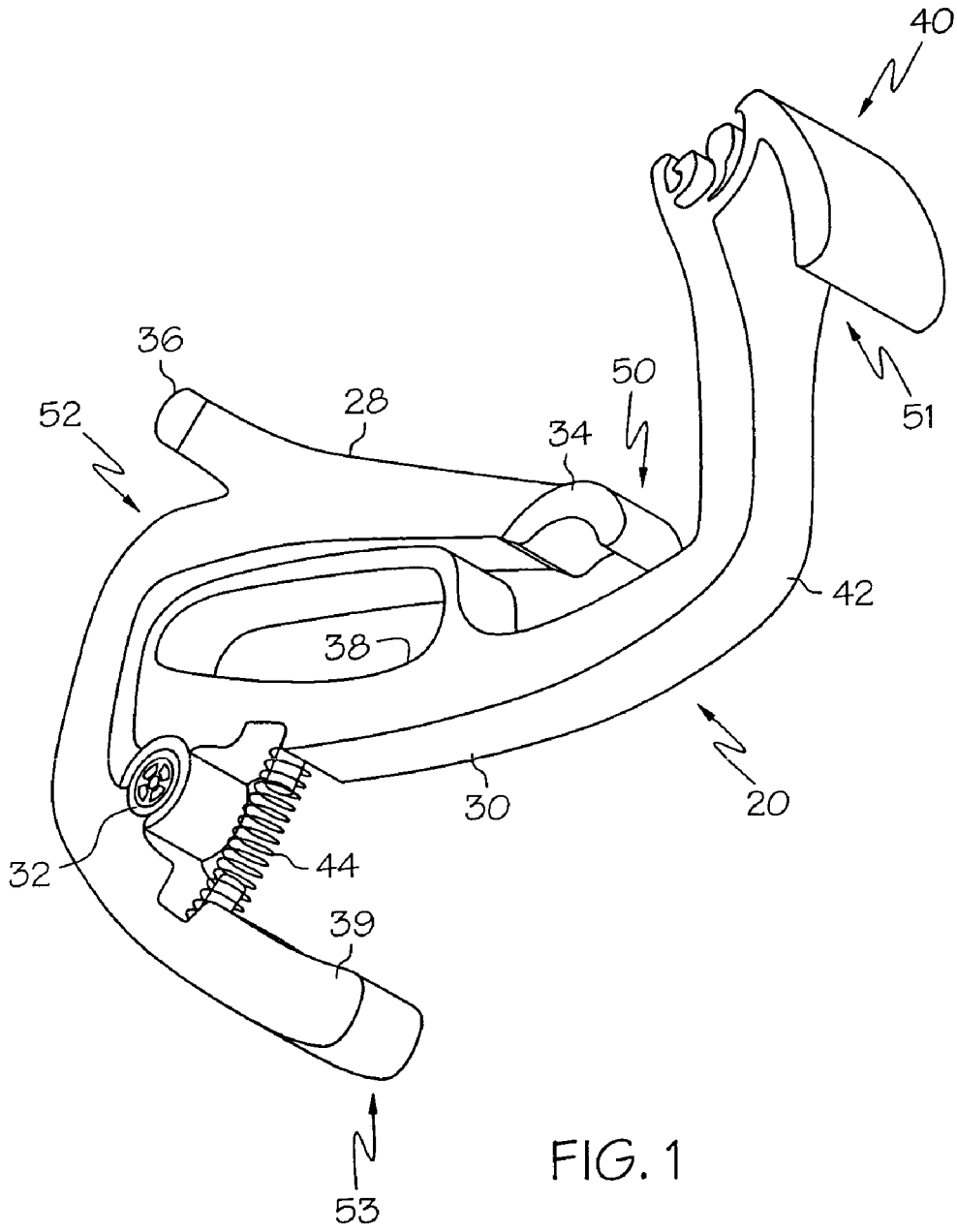
FIG. 1 is a top perspective view of a partition clamp configured in accordance with the present invention.

FIG. 1 is a top perspective view of a partition clamp 20. The clamp 20 includes first and second arms 28, 30, for example in a sinuous shape as shown. The arms pivot relative to each other at a hinge 32 and include a pole interface 34 and head clamp 40. The arms 28, 30 may be formed for example, of a lightweight yet strong material such as plastic, graphite, wood, aluminum alloy, and the like, and may be, for example, machined, molded, or die cast.

Figure 12A:
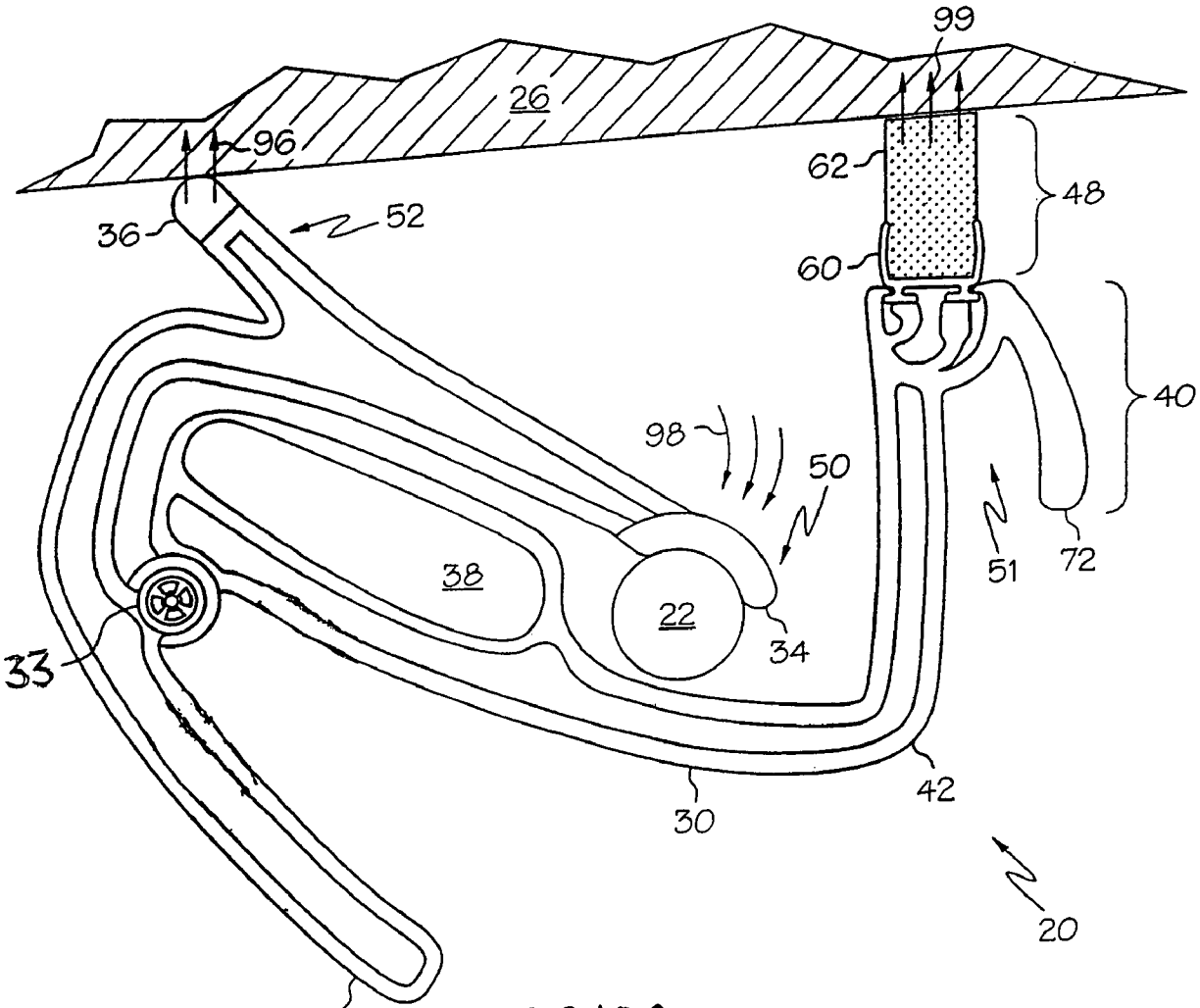
FIGS. 12A and 12B are top views of alternative embodiments of the partition clamp of FIG. 1 mounted between an extension pole and an abutting surface, in accordance with the present invention.

The hinge 32 may be biased, for example by a outwardly-biased spring 44 that is external to the hinge 32 as shown, or optionally, by a inwardly-biased spring 44 that is internal to, or external to, the hinge 32. In an alternative embodiment, as shown in FIG. 12A, the hinge 33 may be ratcheted, so as to urge the arms 28, 30 toward each other along their respective bodies, with or without a spring, as discussed below. The hinge 33 may be integrated into the first and second arms 28, 30, or optionally, may be bonded to, or mounted to, the arms 28, 30.

The first arm 28 is generally in a "C"-shape and includes the pole interface 34 at a distal end 50, the wall interface 36 at a middle portion 52, and a first handle 39 at a proximal end 53. The pole interface 34 comprises, for example, a curved plate or body, having a concave inner surface so as to increase the surface area of the contact region between the first arm 28 and a pole to which the clamp 20 is to be mounted. Alternatively, the pole interface 34 may comprise a rubber or silicone pad that is mounted to, bonded to, or integrated directly with, the first arm 28. The pole interface 34 is urged toward the body of the second arm 30 by the bias of the spring 44 as applied to the hinge 32. The first arm further includes a first handle 39 at a proximal end 53 in order to provide leverage for opening and closing the clamp 52 by exerting pressure against the bias of the spring 44.

Figure 12B:
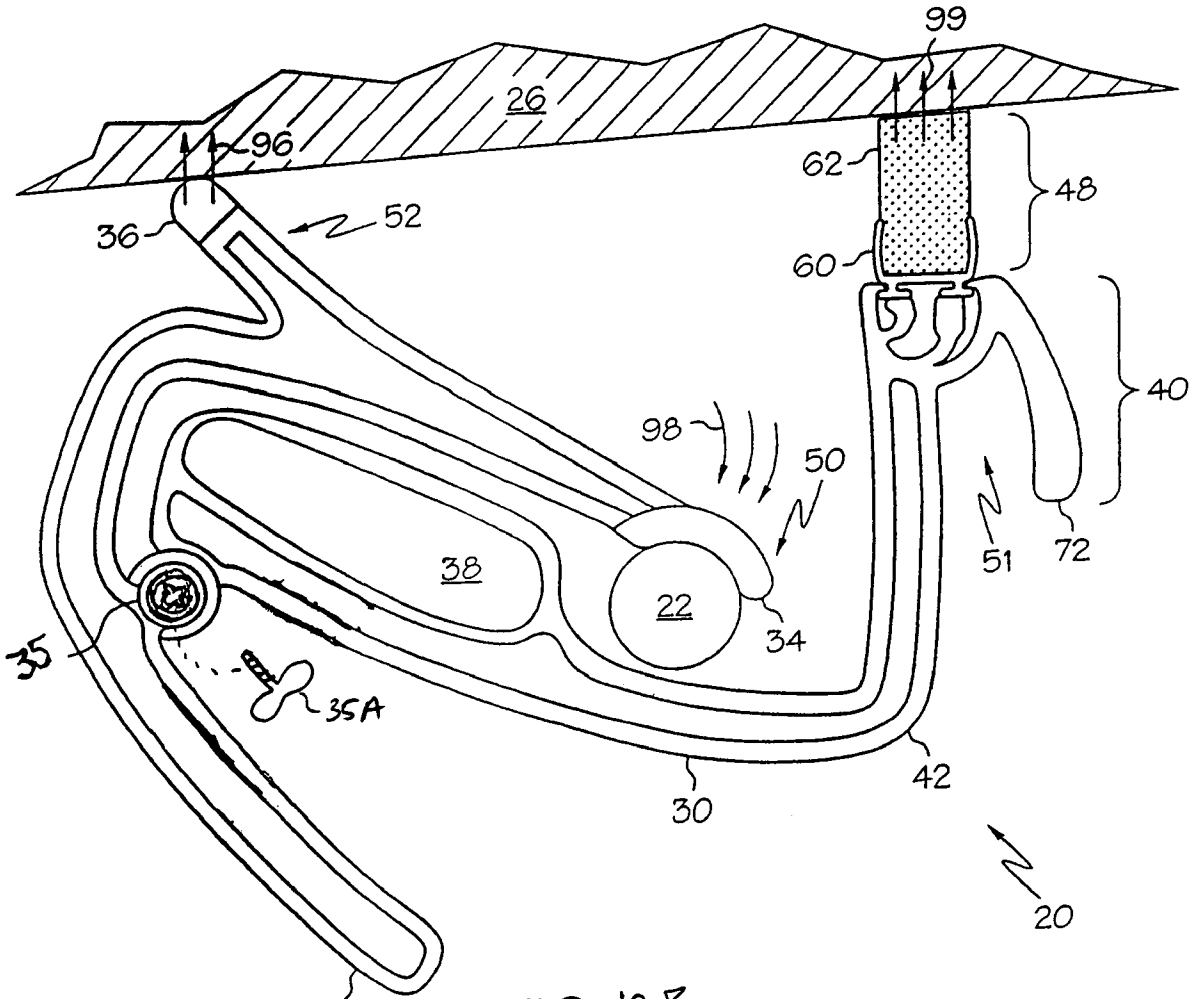

In an alternative embodiment, rather than the spring 44, a passively biased system may be used (for example, a system that does not include a spring 44 for actively and outwardly biasing the pole interface 34 and head clamp 40) including for example, as illustrated in FIG. 12B, a manually-operated screw 35A, for example in the form of a wingnut or knob. In this embodiment, outward tension is applied between the pole interface 34 and the head clamp 40 by manually positioning the clamp 20 between the pole and the wall, and then tightening the manually-operated screw 35A when in place.

The wall interface 36 is, for example, in the shape of a block, pad, semi-cylinder, or point, and provides a surface on the clamp 20 at which the clamp interfaces with a wall, or other abutting surface (window, ceiling, floor, etc.). The wall interface 36 provides for rotational stability in the clamp, preventing the clamp from rotating about the pole when installed, and also provides for lateral stability, preventing the pole from moving from side to side, relative to the abutting surface. To reduce slippage between the wall interface 36 and the abutting surface, a non-skid coating may be applied to the outer surface of the wall interface 36. Alternatively, the wall interface 36 may comprise a rubber or silicone pad that is applied to, bonded to, or integrated directly with, the first arm 28.

The second arm 30 is generally in an "L"-shape and includes a head clamp 40 at a distal end 51 and a second handle 38 at a proximal end 53. The second arm 30 includes a bend 42 along its body such that the distal end 51 of the second arm 30 is able to make contact with the wall, or abutting surface, at head clamp 40, while, at the same time, the pole interface 34 of the first arm 28 is urged against the body of the pole. The second handle 38 is preferably in the form of a hollow or opening of a size suitable for receiving a hand, in order to provide for additional leverage and travel of the second arm 30 with respect to the first arm 28, when releasing and closing the clamp 20.

The head clamp 40 comprises, for example, a clamp that is adapted for receiving a mounting head. The mounting head may comprise, for example, a head having a longitudinally extended body, for example of the type described in U.S. patent application Ser. No. 10/600,300, filed of even date herewith, entitled "Partition Mount with Extended-Length Head", by Jeffery P. Whittemore, et al., the content of which is incorporated herein by reference. A head with an extended body is preferred for increasing the extent of interface between the clamp 20, curtain and abutting surface, to provide a more effective seal therebetween. Alternatively, the head clamp may comprise a ball or socket of a universal joint, for interfacing with the head and clamp of the above patent application, or alternatively, for interfacing with a head of the style illustrated and described in U.S. Pat. No. 5,924,469, incorporated by reference above.

Figure 2:
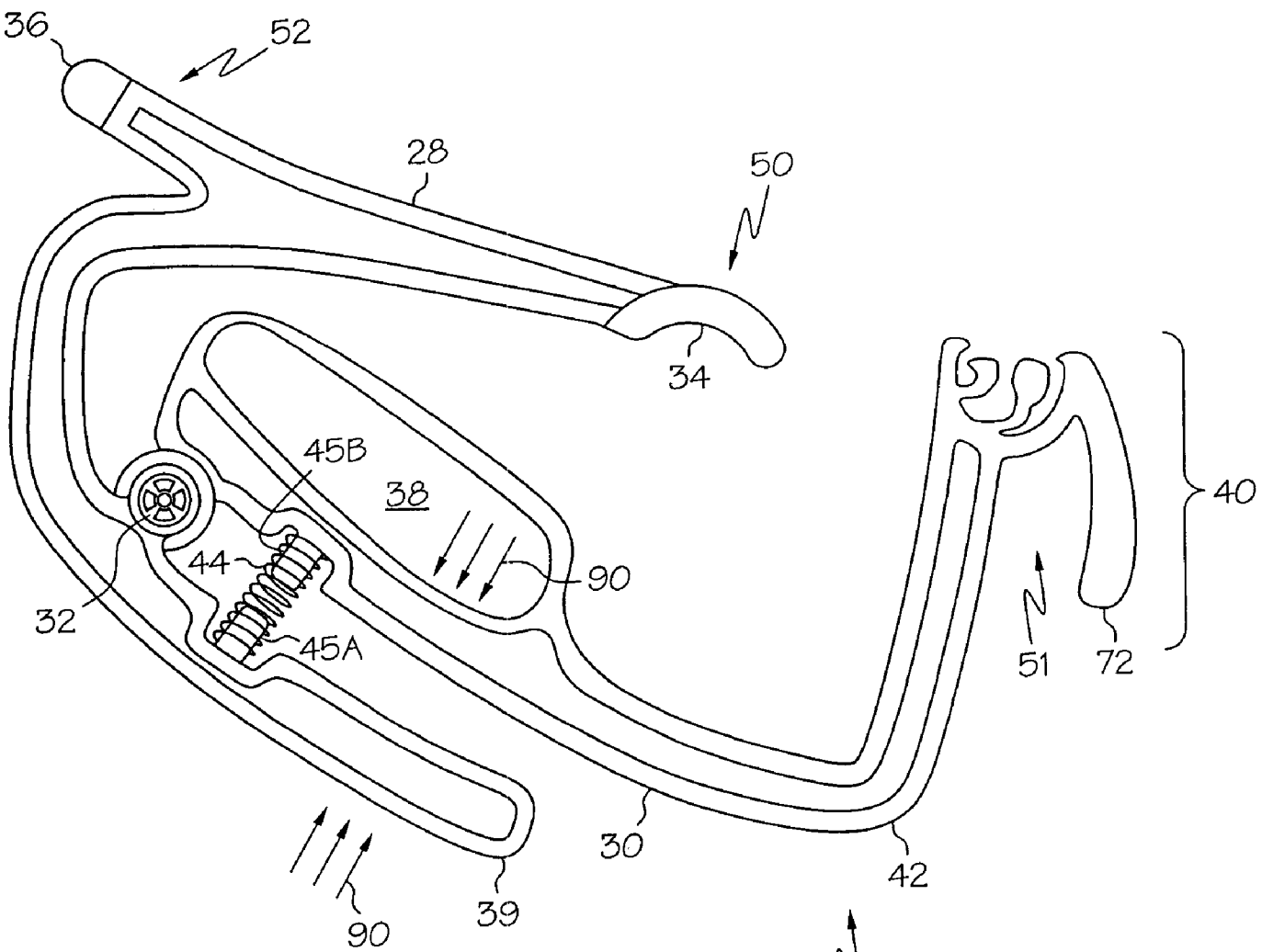
FIG. 2 is a top view of the partition clamp of FIG. 1, in accordance with the present invention.

FIG. 2 is a top view of the partition clamp of FIG. 1, in accordance with the present invention. In this view, pressure is applied between the first handle 38 and second handle 39, as illustrated by arrows 90. This pressure overcomes the outward bias of the spring 44, and the pole interface 34 is thus released from the body of the first arm 30. In this view, it is seen that the outwardly-biased spring 44 is mounted between first and second tabs 45A, 45B formed on the bodies of the first and second arms 28, 30. Other biasing configurations are equally applicable to the present invention, including ratcheting mechanisms, piston-based mechanisms, locking mechanisms, compression mechanisms, and the like. For example, assuming that a ratcheting mechanism is used, spring 44 may not be necessary, and a ratcheting system would control the angular displacement of the first and second handles 38, 39 during mounting to fix them in place. A ratchet release may be included in this example for releasing the resulting tension.

Figure 3:
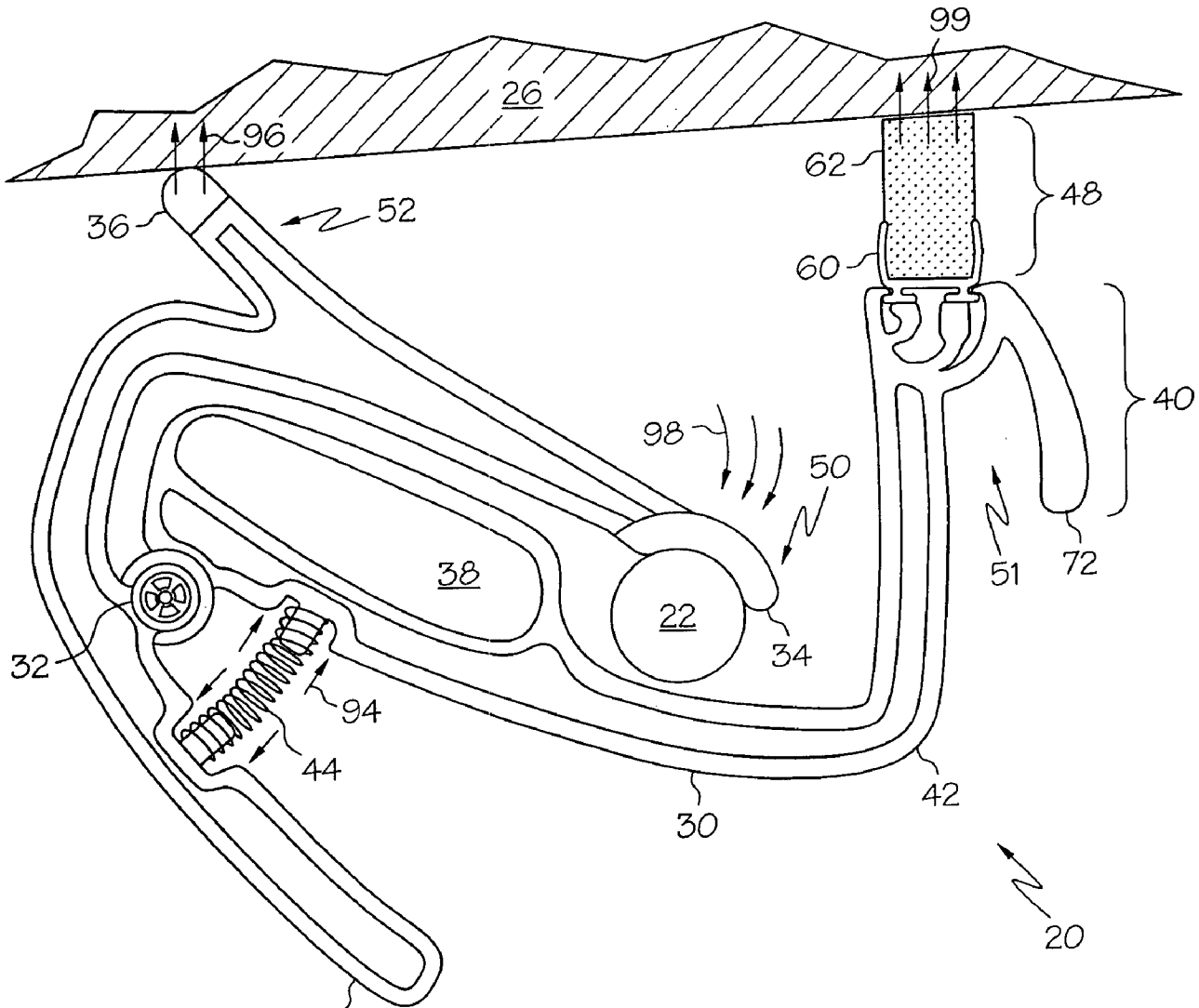
FIG. 3 is a top view of the partition clamp of FIG. 1 mounted between an extension pole and an abutting surface, in accordance with the present invention.

FIG. 3 is a top view of the partition clamp of FIG. 1 mounted between an extension pole 22 and an abutting surface. The pole 22 is erected, for example, between the floor and ceiling of a room. It can be seen in this view that the outward bias of the spring 44 (see arrows 94) serves to contemporaneously urge the wall interface 36 against the wall 26 (see arrows 96), the pole interface 34 against the pole 22 (see arrows 98), and the head clamp 40 and mounting head 48 against the wall 26 (see arrows 99). The outward bias of the spring 44 (or, as in FIG. 9, inward bias of the spring in an inverse pivoting arrangement, or, as in FIG. 12A, ratcheting action in a ratcheting arrangement 33, or, as in FIG. 12B, the tension of a hinge 35 locked in place by a manually operated screw 35A) is preferably sufficiently strong to hold the clamp in place, but not so strong as to overcome the lateral rigidity of the pole 22.

Figure 4A:
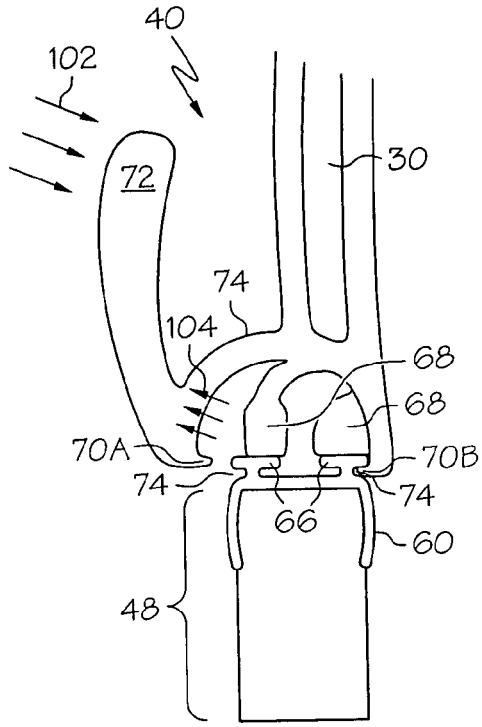
FIGS. 4, 4B and 4C are side views of the curtain interface being mounted to a mounting head, in accordance with the present invention.
Figure 4B:
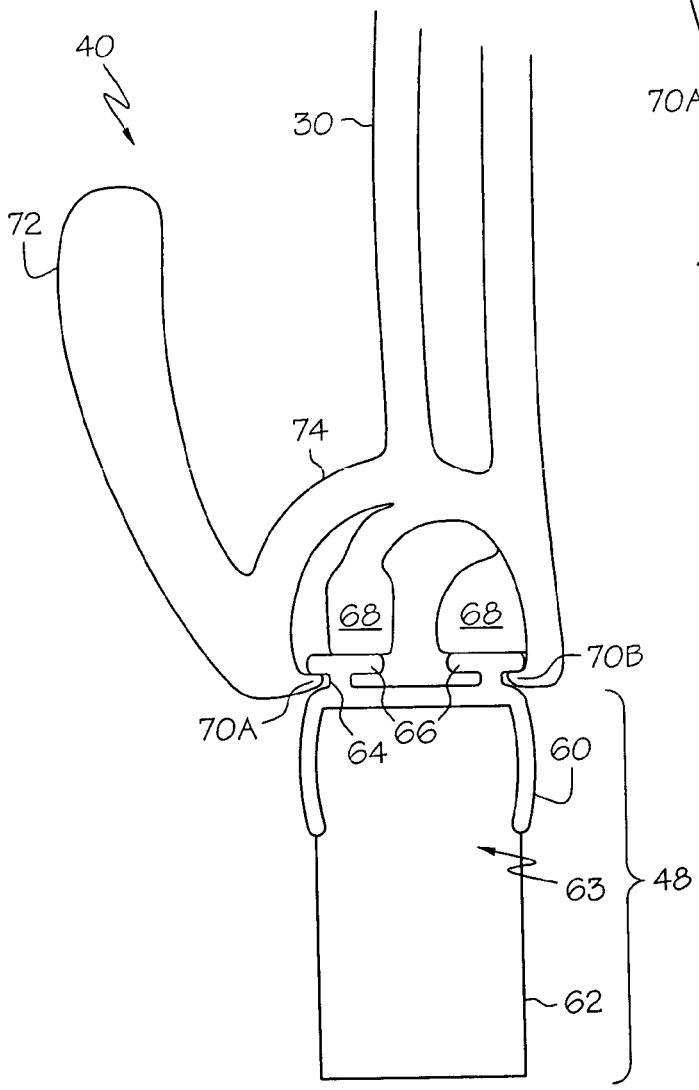

FIGS. 4A and 4B are side views of the head clamp 40 being mounted to a mounting head 48. In this configuration, the head clamp includes an arched body 74 having vertically disposed inner feet 68 and opposed horizontally disposed locking tabs 70A, 70B. A locking tab release handle 72 is coupled to one end of the arched body. The handle provides leverage for elastically deforming the arched body for outwardly moving the locking tabs 70A, 70B relative to each other.

The mounting head 48 includes an elongated body 60 and a compressible pad 62. The body 60 may comprise, for example, an extruded member formed of plastic, aluminum, or alloy, and having a "U"-shaped profile as shown. The pad 62 is mounted in cavity 63 of the body 60, and may be press-fit, or otherwise bonded in place. The pad 62, is, for example, rectangular in shape and may be formed of low-density foam or rubber, having a certain degree of compressibility, while still exhibiting resiliency. The body 60 further includes a horizontal groove 64 on each outer side surface and a top surface 66, as shown. Alternative embodiments of the mounting head are equally applicable to the principles of the present invention, including, for example, those described in U.S. patent application Ser. No. 10/600,300, entitled "Partition Mount with Extended-Length Head", incorporated herein by reference above.

Referring to FIG. 4A, inward pressure (see arrows 102) is applied to a distal end of the handle 72, which causes the arched body 74 of the head clamp 40 to elastically deform in an outward direction as illustrated by arrows 104. This, in turn, causes the locking tabs 70A, 70B to release relative to each other, such that the locking tabs 70A, 70B can be mounted in the horizontal slots 74.

Figure 4C:
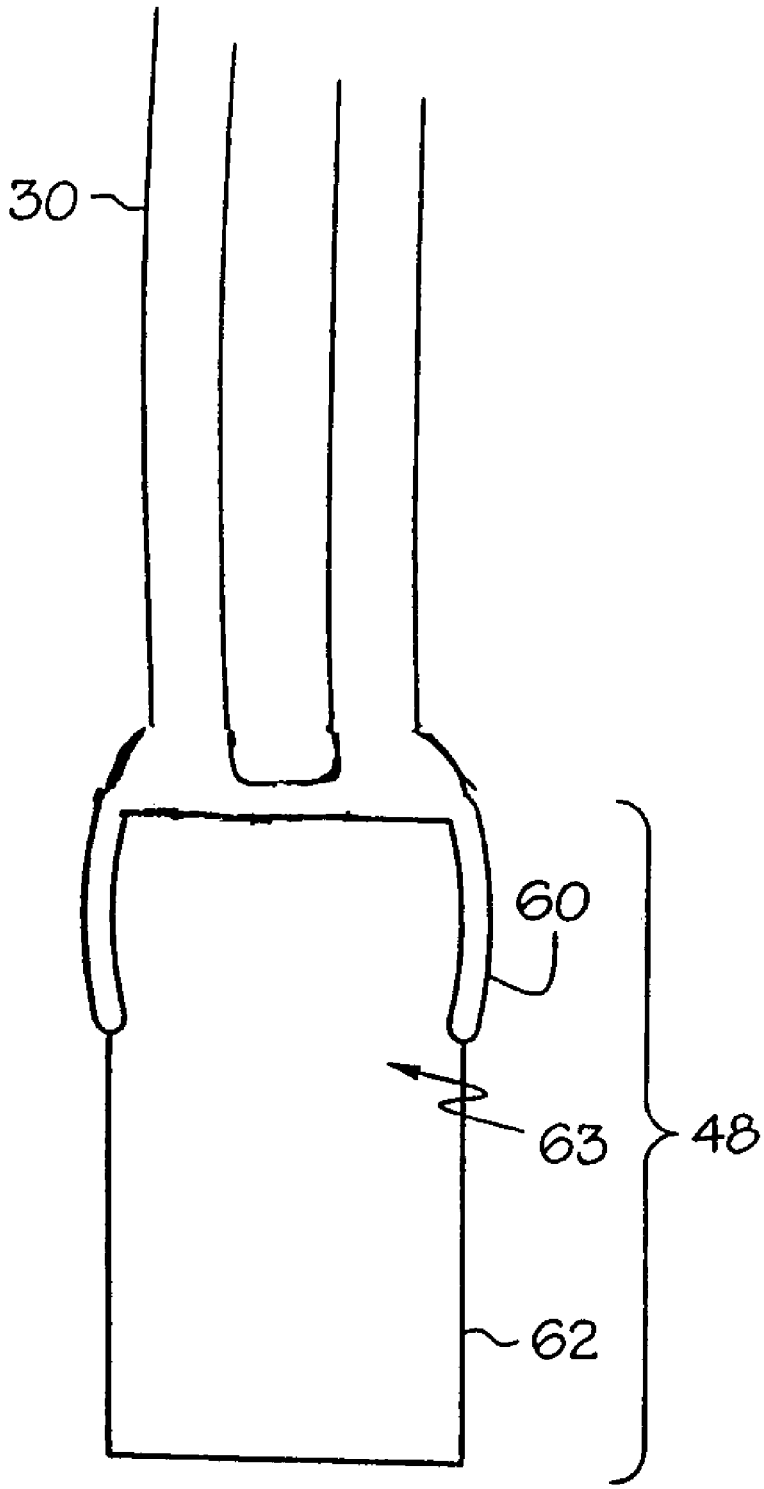

Referring to FIG. 4B, when the pressure 102 is released, the locking tabs 70A are fixed in the horizontal slots 64, and bear on an upper portion thereof. At the same time, inner feet 68, inside the arched body of the head clamp 40 bear down on the upper surface 66 of the body 60 of the mounting head 48. This interaction of locking tabs 70A, 70B and the inner feet 68, secures the head clamp 40 to the mounting head 48. They are released from each other by the same operation. The lower surface of the inner feet 68, and/or the upper surface of the mounting head body 66 may optionally include a non-skid material application, in order to prevent slippage between the units. In an alternative embodiment, as shown in FIG. 4C, the head 48 is integral with the second arm 30.

Figure 5:
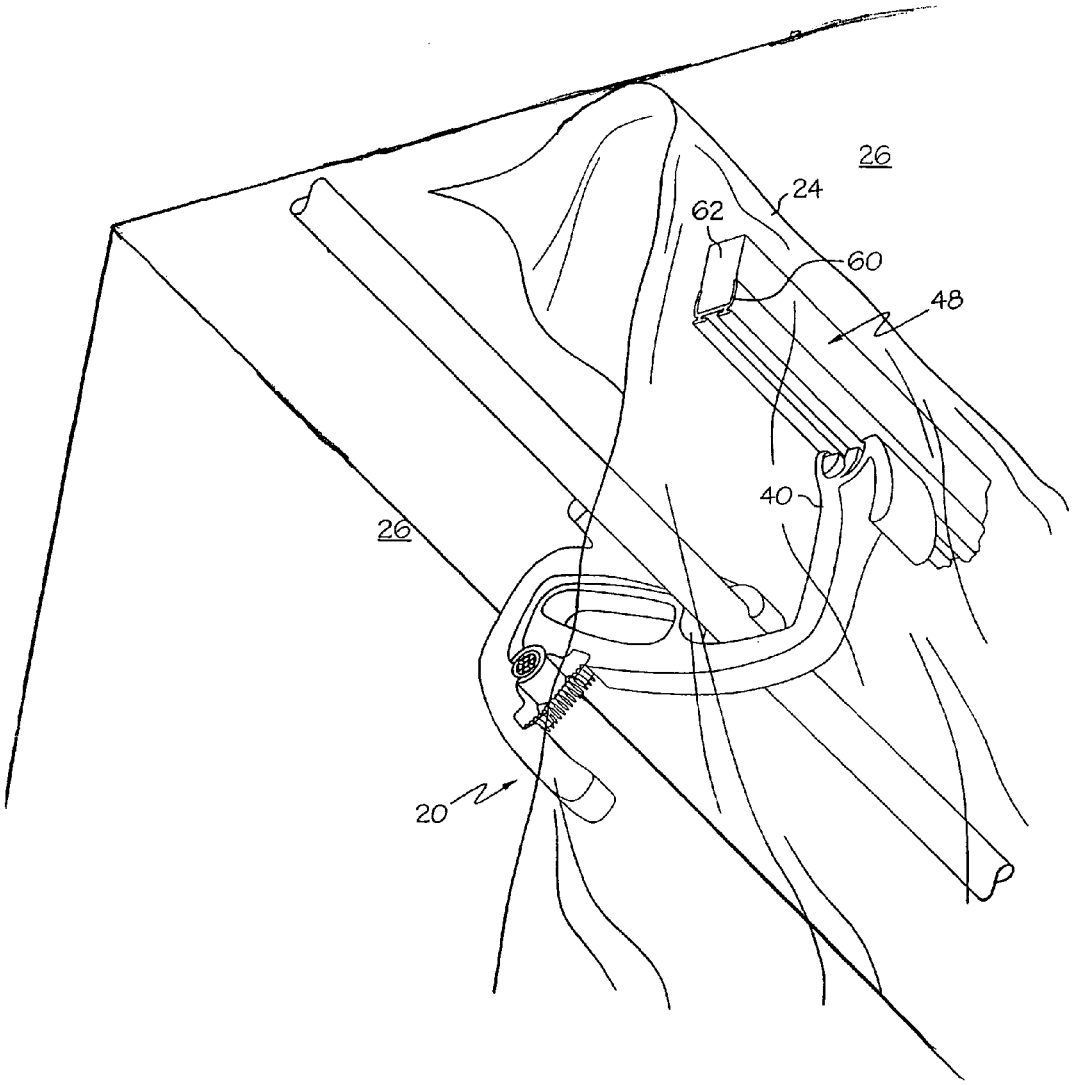
FIG. 5 is a top perspective view of the partition clamp of FIG. 1 mounted to a pole and sealing a curtain against an abutting surface, in accordance with the present invention.

FIG. 5 is a top perspective view of the partition clamp of FIG. 1 mounted to a pole and sealing a curtain against an abutting surface, in this example, a wall. In this view, it can be seen that the body of the head 48 urges the curtain 24 against the wall 26 along its length. In this manner, gaps in the curtain are reduced or eliminated between the pole 22 and the wall 26, leading to a more effective installation.

Figure 6:
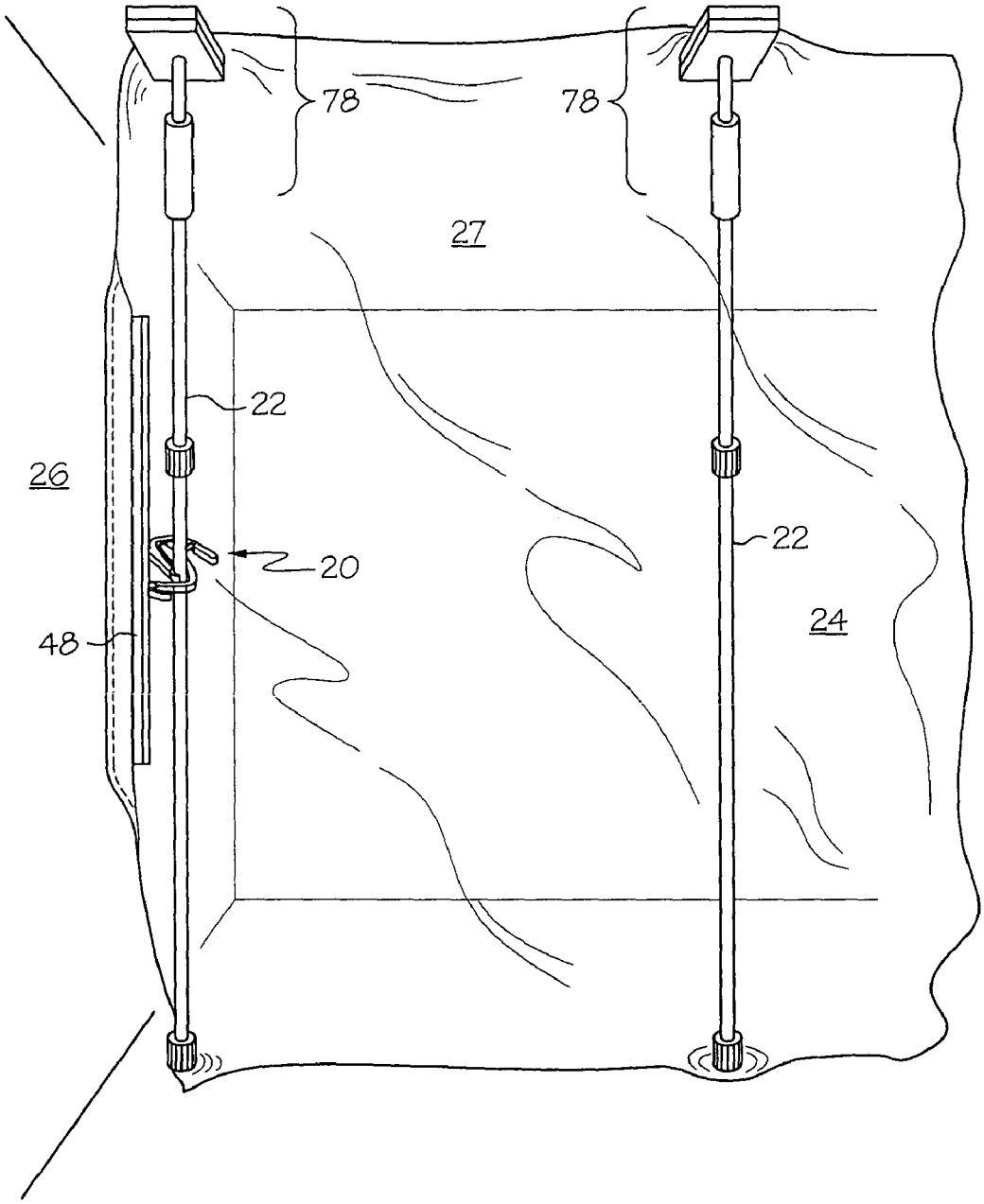
FIG. 6 is a perspective view of the partition clamp of FIG. 1 mounted to a pole and sealing a curtain against an abutting surface, in conjunction with a partition system, in accordance with the present invention.

FIG. 6 is a perspective view of the partition clamp of FIG. 1 mounted to a pole and sealing a curtain against an abutting surface in conjunction with a partition system. In this example, a plurality of extension poles 22 and mounting heads 78, for example as described in U.S. Pat. No. 5,924,469, incorporated herein by reference above, are installed for securing a curtain 24, or sheet of material, in place against a ceiling 27 and wall 26. The system further includes a pole clamp 20 and mounting head 48, as described above, which urges the curtain 24 against the wall 26, using the pole 22 for leverage, thereby reducing the extent of the gap between the curtain 24 and wall 26 in that region.

Figure 7:
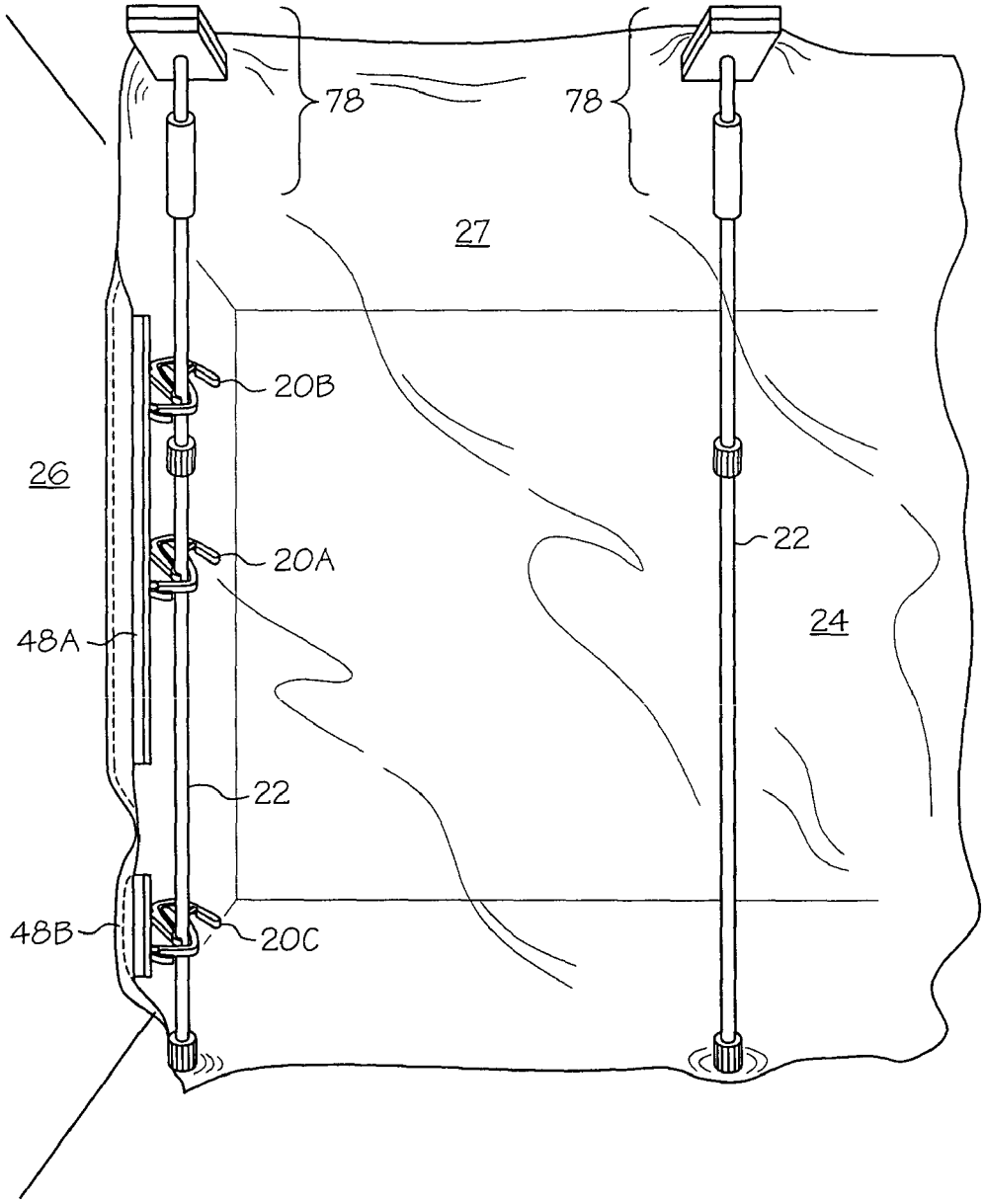
FIG. 7 is a perspective view of multiple partition clamps of FIG. 1 coupled to the same head, and multiple heads and partition clamps mounted to the same pole and sealing a curtain against an abutting surface, in conjunction with a partition system, in accordance with the present invention.

In alternative embodiments, as shown in FIG. 7, multiple clamps 20A, 20B, 20C can be deployed on the same pole 22 with multiple respective heads 48A, 48B, or, alternatively multiple clamps 20A, 20B can share the same head 48B. In another alternative embodiment, the head 48 may be integral with the second arm 30.

In this manner, the present invention provides for mitigation or elimination of gaps between the curtain and abutting surface in a manner that avoids permanent damage to the adjoining wall, ceiling, or other abutting surface, while heightening the effectiveness of an installation.

While this invention has been particularly shown and described with references to preferred embodiments thereof, it will be understood by those skilled in the art that various changes in form and details may be made herein without departing from the spirit and scope of the invention as defined by the appended claims.

Figure 8:
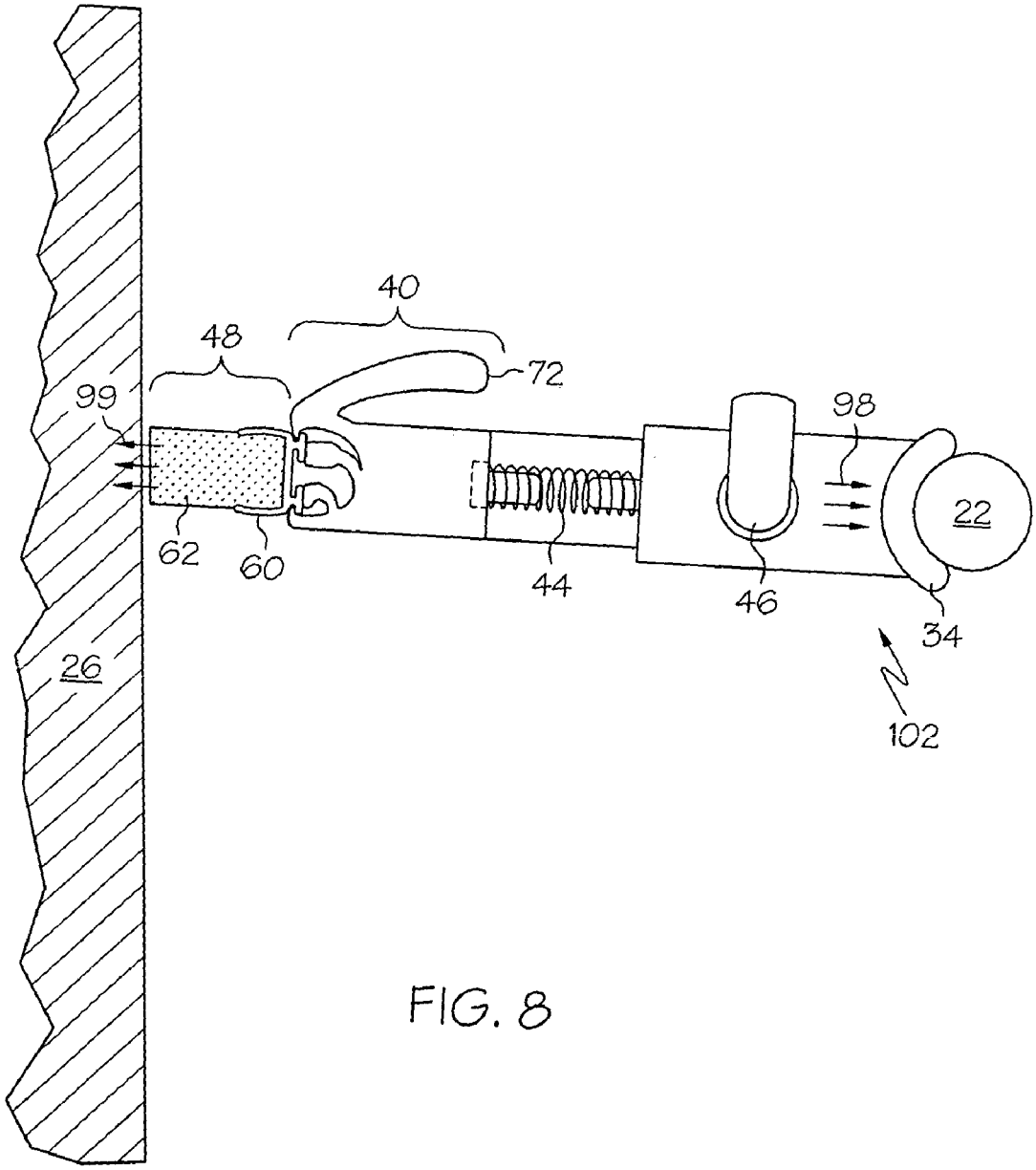
FIG. 8 is a top view of an alternative embodiment of the partition clamp of FIG. 1 mounted between an extension pole and an abutting surface, in accordance with the present invention.

For example, with reference to FIG. 8, in an alternative embodiment, a pole clamp 102 may be provided in a linear configuration as shown, including a pole interface 34 and a head clamp 40 coupled by an outwardly biased spring 44. A hand, or finger, trigger 46 provides a means for leverage in compressing the spring 44 during mounting. The outward bias exerted by the spring 44 operates to urge the pole interface 34 against a pole 22 at arrows 98, and the head clamp 40 and mounting head 48 against a wall 26, or other abutting surface, at arrows 99. Other biasing configurations are equally applicable to the alternative embodiment, including ratcheting mechanisms, piston-based mechanisms, locking mechanisms, compression mechanisms, and the like.

In another example, the pole interface 34 may comprise a clamping mechanism that securedly fixes the pole interface to the pole, irrespective of whether the outward bias of the spring is being applied.

Figure 9:
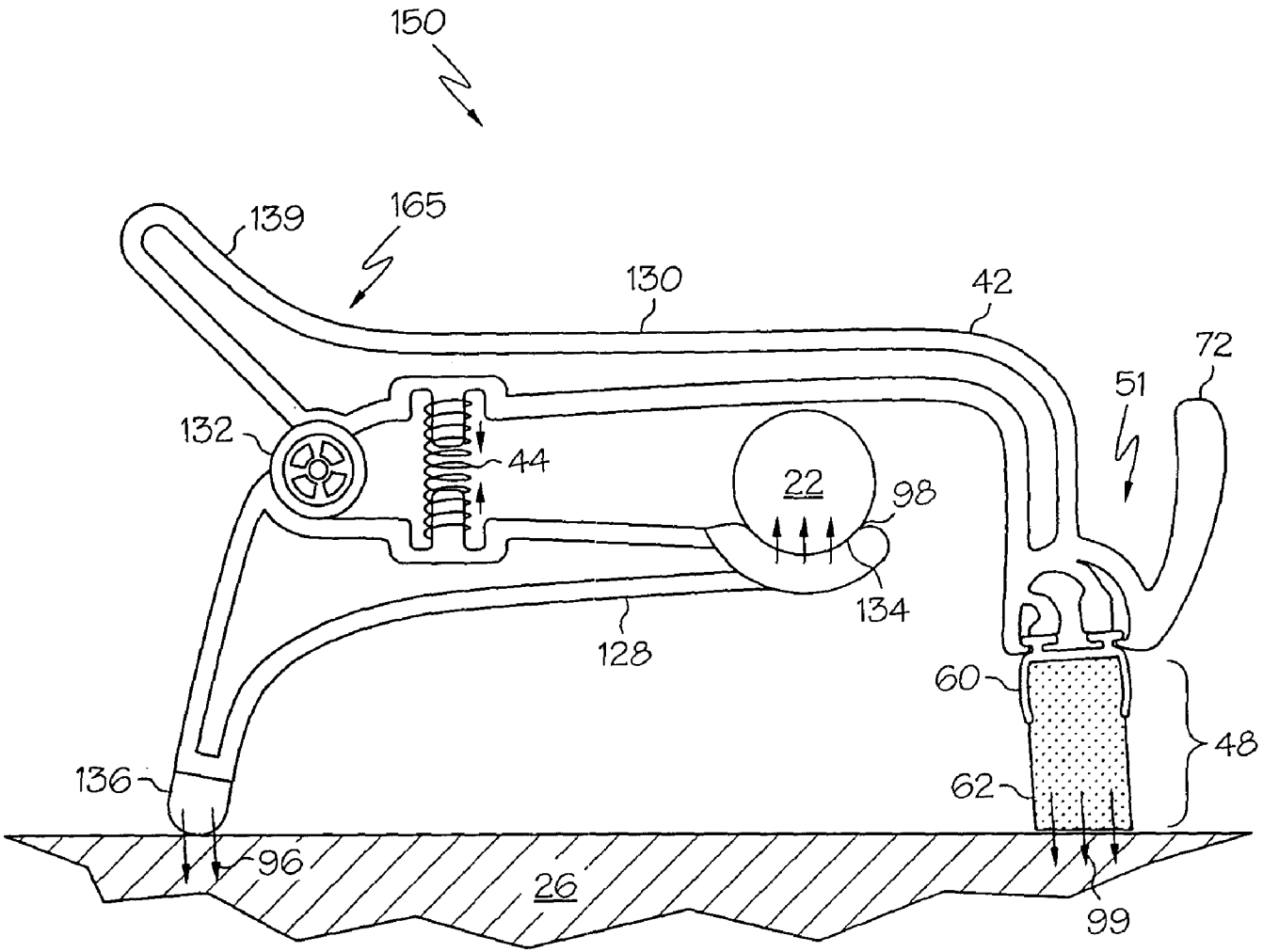
FIG. 9 is a top view of an alternative embodiment of the partition clamp of FIG. 1 mounted between an extension pole and an abutting surface, in accordance with the present invention.

Another example of an alternative embodiment 150 of the partition clamp of the present invention is shown in the top view of FIG. 9. In this embodiment, a handle 139 is located at the proximal end 165 of the second arm 130, in order to provide leverage for opening and closing the clamp 150. A first arm and a second arm are coupled at a hinge 132 and an inwardly biased spring 44 at the proximal end 165 of the second arm 130. A pole interface 134 is urged toward the body of the second arm 130 by the inward bias of the spring 44 as applied to the hinge 132. The inward bias exerted by the spring 44 in turn operates to urge the pole interface 134 against a pole 22 at arrows 98, the wall interface 136 against the wall 26 at arrows 96, and the head clamp 40 and mounting head 48 against a wall 26 at arrows 99. In an alternative embodiment the spring 44 may comprise an outwardly biased spring on the opposite side of the hinge. Other biasing configurations are equally applicable to this alternative embodiment, including ratcheting mechanisms, piston-based mechanisms, locking mechanisms, compression mechanisms, and the like.

Figure 10:
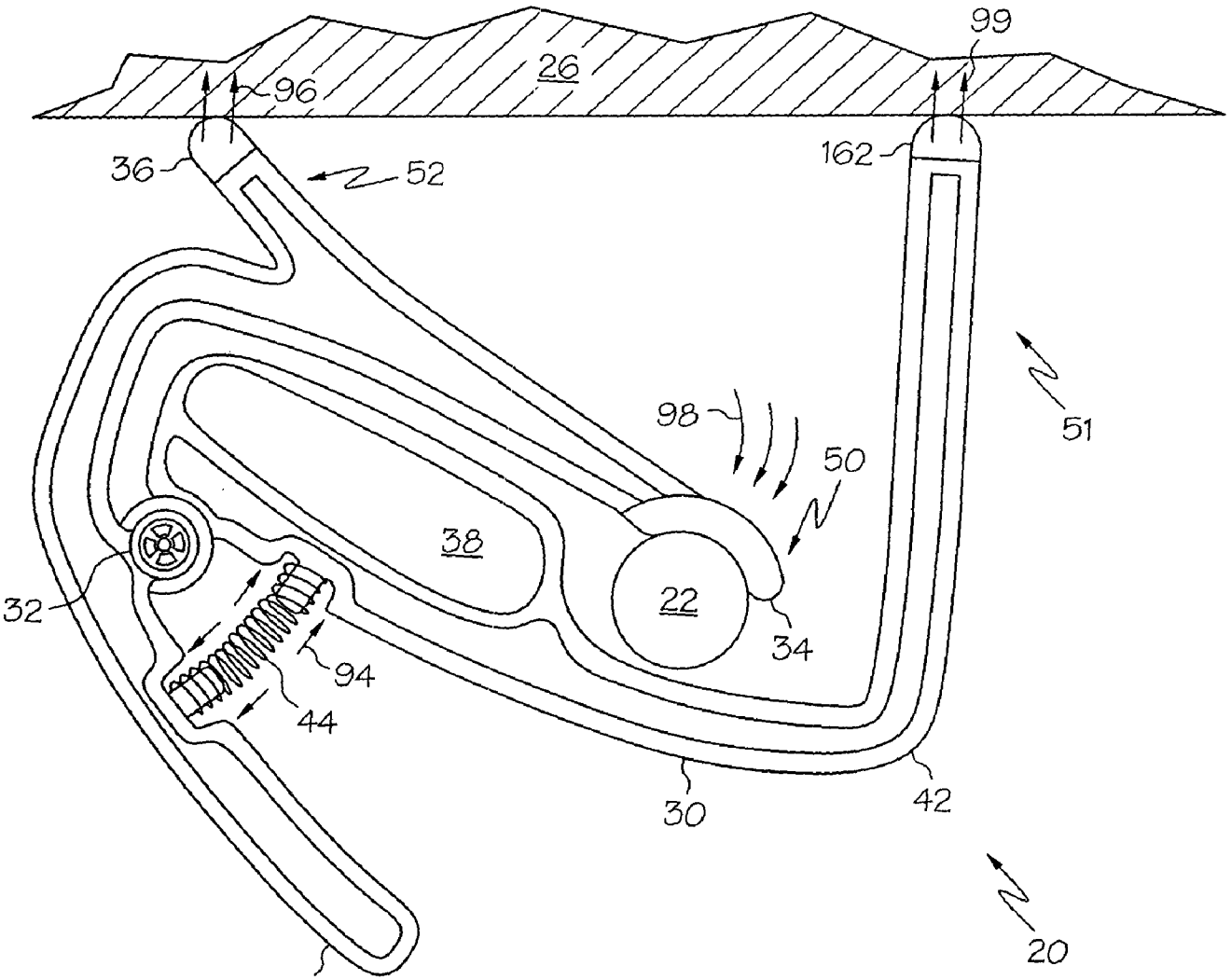
FIG. 10 is a top view of another alternative embodiment of the partition clamp of FIG. 1 mounted between an extension pole and an abutting surface, in accordance with the present invention.

In another example of an alternative embodiment, as shown in the top view of FIG. 10, the head 162 comprises a small pad 162 that is mounted to the proximal end 51 of the second arm 30, as shown. The pad may comprise, for example, a soft rubber, silicone or foam tab that is applied to the end of the second arm. In this embodiment, the pad provides a point of contact at which a mounted curtain is pressed against the wall 26. This embodiment is applicable, for example, in those situations where a more uniform seal of the curtain along the wall, such as that which can be provided by the extended-length head 48 illustrated above, is not necessary.

Figure 11:
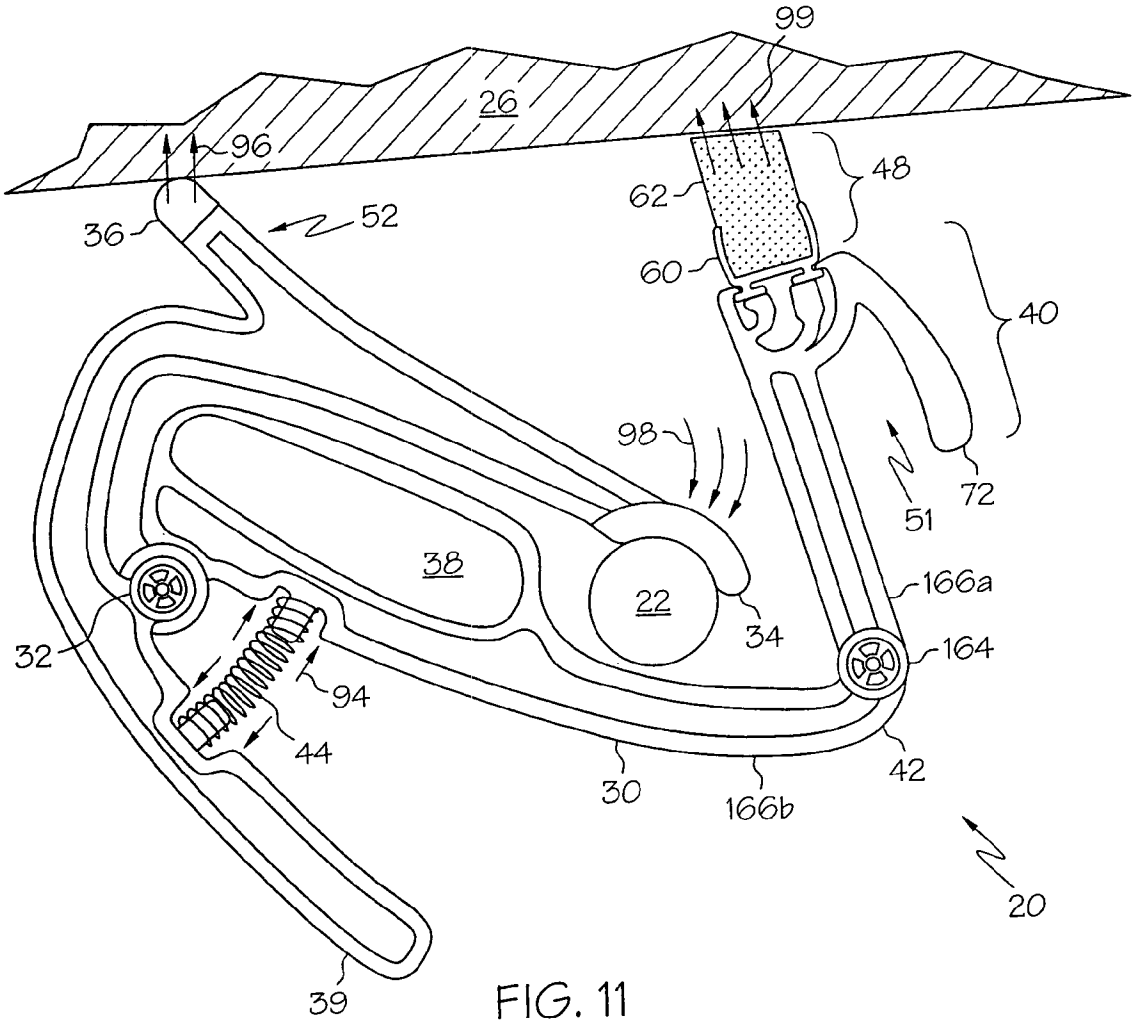
FIG. 11 is a top view of another alternative embodiment of the partition clamp of FIG. 1 mounted between an extension pole and an abutting surface, in accordance with the present invention.

In another example of an alternative embodiment, as shown in the top view of FIG. 11, the second arm 30 includes a hinge 164 for example positioned at the bend 42 in the second arm 30. The hinge 164 allows for flexibility in the configuration of the clamp 20, such that the clamp 20 and associated mounting head 48 can be mounted at a variety of angles with respect to the wall 26. For example, the hinge 164 allows for a variety of angles between the first portion of the second arm 166*a* and a second portion of the second arm 166*b*. A manually operated screw can be included with the hinge for securing the joint once a desired angle is set.

What is claimed is:

1. A partition mount for mounting between a pole and an abutting surface comprising:

a pole interface on a mount body, the pole interface constructed and arranged to removably abut less than an entire perimeter of a side portion of exclusively an external region of the pole, the pole interface comprising a non-skid material;

a head interface on the mount body, the head interface comprising a retaining mechanism adapted for coupling a head to the partition mount, the head interface spaced apart from the pole interface; and a biasing unit that outwardly biases the pole interface and head interface with respect to each other, such that relative positions of the pole interface and the head interface can be varied, and such that when mounted between the pole and the abutting surface, the outward bias of the biasing unit is operative through the pole interface and the head interface to suspend the partition mount in position between the pole and the abutting surface in a manner that the pole interface is the only portion of the partition mount in direct contact with the pole.

2. The partition mount of claim 1 wherein the pole interface is at a first end of the mount body and wherein the head interface is at a second end of the mount body.

3. The partition mount of claim 1 wherein the pole interface comprises a C-shaped body.

4. The partition mount of claim 1 further comprising a head that is integral with the mount body at the head interface.

5. The partition mount of claim 1 wherein the head interface comprises a clamp that is adapted for coupling the partition mount to a head.

6. The partition mount of claim 5 further comprising a head constructed and arranged to be coupled to the head interface, and wherein the head comprises a pad.

7. The partition mount of claim 6 wherein the pad comprises a non-skid material.

8. The partition mount of claim 6 wherein the pad comprises a compressible material.

9. The partition mount of claim 6 wherein the pad is elongated.

10. The partition mount of claim 6 wherein the pad provides a point of contact.

11. The partition mount of claim 5 wherein the head interface is integral with the mount body.

12. The partition mount of claim 1 wherein the head interface comprises one of a ball and socket.

13. The partition mount of claim 1 wherein the mount body, head interface, and pole interface are configured along a common axis.

14. The partition mount of claim 1 wherein the mount body comprises first and second arms coupled by a hinge, and wherein the pole interface is on the first arm and the head interface is on the second arm.

15. The partition mount of claim 14 wherein the first arm is C-shaped and includes the pole interface at a first end and a leverage handle at a second end.

16. The partition mount of claim 15 wherein the first arm further includes a wall interface of non-skid material between the first end and the second end.

17. The partition mount of claim 14 wherein the second arm is L-shaped and includes the head interface at a first end and a grip handle at a second end.

18. The partition mount of claim 17 wherein the second arm includes a hinge such that the head interface and grip handle can be positioned relative to each other at a range of angles.

19. The partition mount of claim 1 wherein the biasing unit comprises a spring.

20. The partition mount of claim 19 wherein the spring is one of inwardly biased and outwardly biased.

21. The partition mount of claim 1 wherein the biasing unit comprises at least one of a ratcheting mechanism and a manually operated screw.

22. The partition mount of claim 1 further comprising a wall interface coupled to the mount body.

23. The partition mount of claim 22 wherein the wall interface comprises non-skid material.

24. The partition mount of claim 1 wherein the mount body comprises a material selected from the group consisting of plastic, graphite, wood, and aluminum alloy.

25. A partition mount for mounting between a pole and an abutting surface comprising:

a mount body comprising first and second arms coupled by a hinge;

a pole interface on the first arm, the pole interface constructed and arranged to removably abut less than an entire perimeter of a side portion of exclusively an external region of the pole, the pole interface comprising a non-skid material;

a head interface on the second arm, the head interface comprising a retaining mechanism adapted for coupling a head to the partition mount, the head interface spaced apart from the pole interface; and a biasing unit that outwardly biases the pole interface and head interface with respect to each other, such that relative positions of the pole interface and the head interface can be varied about the hinge, and such that when mounted between the pole and the abutting surface, the outward bias of the biasing unit is operative through the pole interface and the head interface to suspend the partition mount in position between the pole and the abutting surface, in a manner that the pole interface is the only portion of the partition mount in direct contact with the pole.

26. The partition mount of claim 25 wherein the first arm is C-shaped and includes the pole interface at a first end and a leverage handle at a second end.

27. The partition mount of claim 26 wherein the first arm further includes a wall interface of non-skid material between the first end and the second end.

28. The partition mount of claim 25 wherein the second arm is L-shaped and includes the head interface at a first end and a grip handle at a second end.

29. The partition mount of claim 28 wherein the second arm includes a hinge such that the head interface and grip handle can be positioned relative to each other at a range of angles.

30. The partition mount of claim 25 wherein the biasing unit comprises a spring.

31. The partition mount of claim 25 wherein the pole interface comprises a C-shaped body.

32. The partition mount of claim 25 wherein the pole interface comprises a non-skid material.

33. The partition mount of claim 25 wherein the head interface comprises a clamp that is adapted for coupling the partition mount to a head.

34. The partition mount of claim 33 further comprising a head constructed and arranged to be coupled to the head interface, and wherein the head comprises a pad.

35. The partition mount of claim 34 wherein the pad comprises a non-skid material.

36. The partition mount of claim 34 wherein the pad comprises a compressible material.

37. The partition mount of claim 34 wherein the pad is elongated.

38. The partition mount of claim 34 wherein the pad provides a point of contact.

39. The partition mount of claim 33 wherein the head interface is integral with the mount body.

40. The partition mount of claim 25 wherein the head interface comprises one of a ball and socket.

41. The partition mount of claim 25 further comprising a head that is integral with the mount body at the head interface.

42. The partition mount of claim 30 wherein the spring is one of inwardly biased and outwardly biased.

43. The partition mount of claim 25 wherein the biasing unit comprises at least one of a ratcheting mechanism and a manually operated screw.

44. The partition mount of claim 25 wherein the mount body comprises a material selected from the group consisting of plastic, graphite, wood, and aluminum alloy.

45. A partition mount for mounting between a pole and an abutting surface comprising:

a pole interface coupled to a mount body, the pole interface constructed and arranged to removably abut less than an entire perimeter of a side portion of exclusively an external region of the pole;

an elongated head comprising a pad of non-skid material;

a head interface coupled to the mount body, the head interface comprising a clamp that couples the mount body to the head, the head extending in a transverse direction relative to the mount body; and a biasing unit for outwardly biasing the pole interface and head interface with respect to each other such that relative positions of the pole interface and the head interface can be varied, and such that when mounted between the pole and the abutting surface, the outward bias of the biasing unit is operative through the pole interface and the head interface to suspend the partition mount in position between the pole and the abutting surface.

46. A partition mount for mounting between a pole and an abutting surface comprising:

a pole interface coupled to a mount body, the pole interface constructed and arranged to removably abut less than an entire perimeter of a side portion of exclusively an external region of the pole;

an elongated head comprising a pad of compressible material;

a head interface coupled to the mount body, the head interface comprising a clamp that couples the mount body to the head, the head extending in a transverse direction relative to the mount body; and a biasing unit for outwardly biasing the pole interface and head interface with respect to each other such that relative positions of the pole interface and the head interface can be varied, and such that when mounted between the pole and the abutting surface, the outward bias of the biasing unit is operative through the pole interface and the head interface to suspend the partition mount in position between the pole and the abutting surface.

47. A partition mount for mounting between a pole and an abutting surface comprising:

a pole interface coupled to a mount body, the pole interface constructed and arranged to removably abut less than an entire perimeter of a side portion of exclusively an external region of the pole;

an elongated head comprising a pad that is elongated;

a head interface coupled to the mount body, the head interface comprising a clamp that couples the mount body to the head, the head extending in a transverse direction relative to the mount body; and a biasing unit for outwardly biasing the pole interface and head interface with respect to each other such that relative positions of the pole interface and the head interface can be varied, and such that when mounted between the pole and the abutting surface, the outward bias of the biasing unit is operative through the pole interface and the head interface to suspend the partition mount in position between the pole and the abutting surface.

48. A partition mount for mounting between a pole and an abutting surface comprising:

a pole interface coupled to a mount body, the pole interface constructed and arranged to removably abut less than an entire perimeter of a side portion of exclusively an external region of the pole;

an elongated head that provides a point of contact with the abutting surface;

a head interface coupled to the mount body, the head interface comprising a clamp that couples the mount body to the head, the head extending in a transverse direction relative to the mount body; and a biasing unit for outwardly biasing the pole interface and head interface with respect to each other such that relative positions of the pole interface and the head interface can be varied, and such that when mounted between the pole and the abutting surface, the outward bias of the biasing unit is operative through the pole interface and the head interface to suspend the partition mount in position between the pole and the abutting surface.

49. A partition mount for mounting between a pole and an abutting surface comprising:

a pole interface coupled to a mount body, the pole interface constructed and arranged to removably abut less than an entire perimeter of a side portion of exclusively an external region of a pole;

a head interface coupled to the mount body;

a wall interface coupled to the mount body, the wall interface comprises non-skid material on an external, outer surface of the mount body; and a biasing unit for outwardly biasing the pole interface and head interface with respect to each other such that relative positions of the pole interface and the head interface can be varied about the hinge, and such that when mounted between the pole and the abutting surface, the outward bias of the biasing unit is operative through the pole interface and the head interface to suspend the partition mount in position between the pole and the abutting surface.

50. A partition mount for mounting between a pole and an abutting surface comprising:

a mount body comprising first and second arms coupled by a hinge;

a pole interface coupled to the first arm, the pole interface constructed and arranged to removably abut less than an entire perimeter of a side portion of exclusively an external region of the pole;

an elongated head comprising a pad of non-skid material;

a head interface coupled to the second arm, the head interface comprising a clamp that couples the mount body to the head, the head extending in a transverse direction relative to the mount body; and a biasing unit for outwardly biasing the pole interface and head interface with respect to each other such that relative positions of the pole interface and the head can be varied, and such that when mounted between the pole and the abutting surface, the outward bias of the biasing unit is operative through the pole interface and the head to suspend the partition mount in position between the pole and the abutting surface.

51. A partition mount for mounting between a pole and an abutting surface comprising:

a mount body comprising first and second arms coupled by a hinge;

a pole interface coupled to the first arm, the pole interface constructed and arranged to removably abut less than an entire perimeter of a side portion of exclusively an external region of the pole;

an elongated head comprising a pad of compressible material;

a head interface coupled to the second arm, the head interface comprising a clamp that couples the mount body to the head, the head extending in a transverse direction relative to the mount body; and a biasing unit for outwardly biasing the pole interface and head interface with respect to each other such that relative positions of the pole interface and the head can be varied, and such that when mounted between the pole and the abutting surface, the outward bias of the biasing unit is operative through the pole interface and the head to suspend the partition mount in position between the pole and the abutting surface.

52. A partition mount for mounting between a pole and an abutting surface comprising:

a mount body comprising first and second arms coupled by a hinge;

a pole interface coupled to the first arm, the pole interface constructed and arranged to removably abut less than an entire perimeter of a side portion of exclusively an external region of the pole;

an elongated head comprising a pad that is elongated;

a head interface coupled to the second arm, the head interface comprising a clamp that couples the mount body to the head, the head extending in a transverse direction relative to the mount body; and a biasing unit for outwardly biasing the pole interface and head interface with respect to each other such that relative positions of the pole interface and the head can be varied, and such that when mounted between the pole and the abutting surface, the outward bias of the biasing unit is operative through the pole interface and the head to suspend the partition mount in position between the pole and the abutting surface.

53. A partition mount for mounting between a pole and an abutting surface comprising:

a mount body comprising first and second arms coupled by a hinge;

a pole interface coupled to the first arm, the pole interface constructed and arranged to removably abut less than an entire perimeter of a side portion of exclusively an external region of the pole;

an elongated head that provides a point of contact with an abutting surface;

a head interface coupled to the second arm, the head interface comprising a clamp that couples the mount body to the head, the head extending in a transverse direction relative to the mount body; and a biasing unit for outwardly biasing the pole interface and head interface with respect to each other such that relative positions of the pole interface and the head can be varied, and such that when mounted between the pole and the abutting surface, the outward bias of the biasing unit is operative through the pole interface and the head to suspend the partition mount in position between the pole and the abutting surface.

54. A partition mount for mounting between a pole and an abutting surface comprising:

a mount body comprising first and second arms coupled by a hinge and having a thickness in a transverse direction;

a pole interface coupled to the first arm, the pole interface constructed and arranged to removably abut less than an entire perimeter of a side portion of exclusively an external region of a pole;

an elongated head integral with and coupled to the second arm, and extending in the transverse direction relative to the mount body over a length that is greater than the thickness; and a biasing unit for outwardly biasing the pole interface and head with respect to each other such that relative positions of the pole interface and the head can be varied, and such that when mounted between a pole and an abutting surface, the outward bias of the biasing unit is operative through the pole interface and the head to suspend the partition mount in position between the pole and the abutting surface.

55. The partition mount of claim 54 wherein the pole interface comprises a C-shaped body.

56. The partition mount of claim 54 wherein the head comprises a pad of non-skid material.

57. The partition mount of claim 56 wherein the pad comprises a compressible material.

58. The partition mount of claim 54 wherein the pole interface is on the first arm and the head is on the second arm.

59. The partition mount of claim 54 wherein the biasing unit comprises a spring that is one of inwardly biased and outwardly biased.

60. The partition mount of claim 54 further comprising a wall interface coupled to the mount body.

61. A partition mount for mounting between a pole and an abutting surface comprising:

a mount body comprising first and second arms coupled by a hinge;

a pole interface coupled to the first arm, the pole interface constructed and arranged to removably abut a perimeter of the side portion of exclusively an external region of the pole, the first arm being C-shaped and including the pole interface at a first end and a leverage handle at a second end, and a wall interface of non-skid material between the first end and the second end;

a head interface coupled to the second arm, the second arm being L-shaped and including the head interface at a first end and a grip handle at a second end; and a biasing unit for outwardly biasing the pole interface and head interface with respect to each other such that relative positions of the pole interface and the head interface can be varied about the hinge, and such that when mounted between the pole and the abutting surface, the outward bias of the biasing unit is operative through the pole interface and the head interface to suspend the partition mount in position between the pole and the abutting surface.

62. The partition mount of claim 61 wherein the second arm includes a hinge such that the head interface and grip handle can be positioned relative to each other at a range of angles.

63. A partition mount for mounting between a pole and an abutting surface comprising:

a pole interface on a mount body, the pole interface constructed and arranged to removably abut less than an entire perimeter of a side portion of exclusively an external region of the pole;

a head interface on the mount body, the head interface comprising a clamp that is adapted for coupling a head to the partition mount;

a head constructed and arranged to be coupled to the head interface, wherein the head comprises a pad and a biasing unit that outwardly biases the pole interface and head interface with respect to each other, such that relative positions of the pole interface and the head interface can be varied, and such that when mounted between the pole and the abutting surface, the outward bias of the biasing unit is operative through the pole interface and the head interface to suspend the partition mount in position between the pole and the abutting surface.

64. The partition mount of claim 63 wherein the pad comprises a non-skid material.

65. The partition mount of claim 63 wherein the pad comprises a compressible material.

66. The partition mount of claim 63 wherein the pad is elongated.

67. The partition mount of claim 63 wherein the pad provides a point of contact with the abutting surface.

68. A partition mount for mounting between a pole and an abutting surface comprising:

a mount body comprising first and second arms coupled by a hinge;

a pole interface on the first arm, the pole interface constructed and arranged to removably abut less than an entire perimeter of a side portion of exclusively an external region of the pole;

a head interface on the second arm, wherein the head interface comprises a clamp that is adapted for coupling a head to the partition mount;

a head constructed and arranged to be coupled to the head interface, wherein the head comprises a pad; and a biasing unit that outwardly biases the pole interface and head interface with respect to each other, such that relative positions of the pole interface and the head interface can be varied about the hinge, and such that when mounted between the pole and the abutting surface, the outward bias of the biasing unit is operative through the pole interface and the head interface to suspend the partition mount in position between the pole and the abutting surface.

69. The partition mount of claim 68 wherein the pad comprises a non-skid material.

70. The partition mount of claim 68 wherein the pad comprises a compressible material.

71. The partition mount of claim 68 wherein the pad is elongated.

72. The partition mount of claim 68 wherein the pad provides a point of contact with the abutting surface.

73. A partition mount for mounting between a pole and an abutting surface comprising:

a pole interface on a mount body, the pole interface constructed and arranged to removably abut less than an entire perimeter of a side portion of exclusively an external region of the pole, the pole interface comprising a non-skid material, the mount body having a thickness in a transverse direction;

an elongated head integral with and coupled to the mount body, and extending in the transverse direction relative to the mount body over a length that is greater than the thickness; and a biasing unit that outwardly biases the pole interface and head with respect to each other, such that relative positions of the pole interface and the head can be varied, and such that when mounted between the pole and the abutting surface, the outward bias of the biasing unit is operative through the pole interface and the head to suspend the partition mount in position between the pole and the abutting surface.

74. The partition mount of claim 73 wherein the pole interface comprises a C-shaped body.

75. The partition mount of claim 73 wherein the head comprises a pad of non-skid material.

76. The partition mount of claim 75 wherein the pad comprises a compressible material.

77. The partition mount of claim 73 wherein the mount body comprises first and second arms coupled by a hinge, and wherein the pole interface is on the first arm and the head is on the second arm.

78. The partition mount of claim 73 wherein the biasing unit comprises a spring that is one of inwardly biased and outwardly biased.

79. The partition mount of claim 73 further comprising a wall interface coupled to the mount body.

* * * * *